US005628115A

United States Patent [19]

Hebert

[11] Patent Number: 5,628,115

[45] Date of Patent: May 13, 1997

[54] CUTTING TOOL

[76] Inventor: Paul W. Hebert, 6450 Lakeshore Dr., San Diego, Calif. 92119

[21] Appl. No.: 580,895

[22] Filed: Dec. 29, 1995

[51] Int. Cl.[6] ..... B26B 13/25; B26B 13/06

[52] U.S. Cl. ..... 30/262; 30/261

[58] Field of Search ..... 30/261, 262

[56] References Cited

U.S. PATENT DOCUMENTS

| | | | |
|---|---|---|---|
| 663,565 | 12/1900 | Fisher | 30/261 |
| 1,814,821 | 7/1931 | Botts | 30/261 |
| 2,392,118 | 1/1946 | Cacarillo | 30/261 |

FOREIGN PATENT DOCUMENTS

| | | | |
|---|---|---|---|
| 493305 | 4/1954 | Italy | 30/261 |

*Primary Examiner*—Douglas Watts
*Attorney, Agent, or Firm*—Charles C. Logan, II

[57] ABSTRACT

A cutting tool designed for hand cutting/harvesting of grapes and trimming shrubs and flowers. It has two elongated members pivotally secured together at a locus axis passing perpendicularly through their respective head portions. The surfaces of the respective head portions that mate against each other have annular grooves that removably receive a coiled spring between them. The coiled spring functions to keep the cutting edges of the tool separated when there isn't any hand pressure squeezing the respective hand portions toward each other to perform a cutting operation. A brass washer under the head of the bolt holding the respective head portions together assures smooth pivotal movement of the head portions when the respective hand portions are squeezed toward each other.

1 Claim, 1 Drawing Sheet

CUTTING TOOL

BACKGROUND OF THE INVENTION

The invention relates to a cutting tool and more specifically to one for use in hand cutting/harvesting of premier grapes or trimming flowers and shrubs.

Presently there are existing cutting tools for hand cutting/harvesting of premier grapes. They have a spring mechanism that keeps the cutting tools respective blade section separated when there isn't any hand pressure squeezing the handle portions toward each other. They have an external spring or telescoped band that extends between the respective handle portions. This external spring structure other often gets entangled in twigs, branches, leaves etc. when the cutting operation is being performed. When these branches, twigs, leaves, etc. become entangled in the exteriorly mounted spring mechanism, it results in inhibiting the cutting efficiency and capability of the tool. When flowers such as roses or exotic flowers are being trimmed, different portions of the stem, branches, leaves, etc. often get caught between the two handles and if they are accidentally removed the aesthetic appearance of the flowers is diminished. The external spring mechanism provides an impediment to cutting a bunch of grapes cleanly from the vine.

It is an object of the invention to provide a novel cutting tool that has been designed to be specifically used for hand cutting/harvesting premier grapes.

It is also an object of the invention to provide a novel cutting tool that can also be used for cutting flowers roses or shrubs.

It is another object of the invention to provide a novel cutting tool that has structure to keep the respective blade sections separated when there isn't any hand pressure squeezing the respective handle portions toward each other.

It is an additional object of the invention to provide a novel cutting tool that is economical to manufacture and market.

It is a further object of the invention to provide a novel cutting tool that can be easily assembled and disassembled.

SUMMARY OF THE INVENTION

The novel cutting tool has been primarily designed for hand cutting/harvesting of premier grapes. It has a pair of cooperating elongated members each having a handle portion and a head portion. The head portions are pivotally secured together at a locus axis passing perpendicularly through the respective head portions. A blade section extends forwardly from each of the head portions and they each have front cutting edges that pass across each other as the respective handle portions are squeezed together.

The bottom surface of the head portion of the top elongated member and the top surface of the head portion of the bottom elongated member each have an annular groove formed in their respective surfaces. Each of these annular grooves also has an axial groove extending outwardly from their periphery. A coiled spring having a first end, a second end and a loop portion is removably received between the respective head portions. The loop portion seats in the respective annular grooves. The first and second ends of the coiled spring are inserted in the respective axial grooves to prevent rotation of the coiled spring. The shank of a bolt passes through a brass washer and aligned bore holes in the respective head portions and also through the center of the coiled spring. A nut is screwed onto the end of the bolt to hold the respective head portions together. The brass washer is self lubricating and thus allows for smooth movement in wet conditions such as dew, rain, etc.

The bolt has a shank portion having two opposed flat surfaces and two opposed arcuate surfaces. One of the head portions has its bore hole configured to mate with the specific peripheral shape of the shank portion to insure that the bolt is always properly aligned as it passes through the respective bore holes. The other head portion has a circular shaped aperture.

One of the handle portions has a hook-shaped protrusion extending inwardly. The other handle portion has an inwardly extending flange with a closed loop latch pivotally mounted thereon. The respective blades of the cutting tool can be locked together by squeezing the handle portions together by squeezing the handle portions together and passing the closed loop latch around the hook-shaped protrusion. The rear ends of the respective handle portions have outwardly bent foot portions to prevent the hands of the person using the cutting tool from slipping off the ends of the handles.

The blade sections each have longitudinally extending axes. These axes are curved upward from their rear ends to their front ends.

DESCRIPTION OF THE PREFERRED EMBODIMENT

Figure 1:
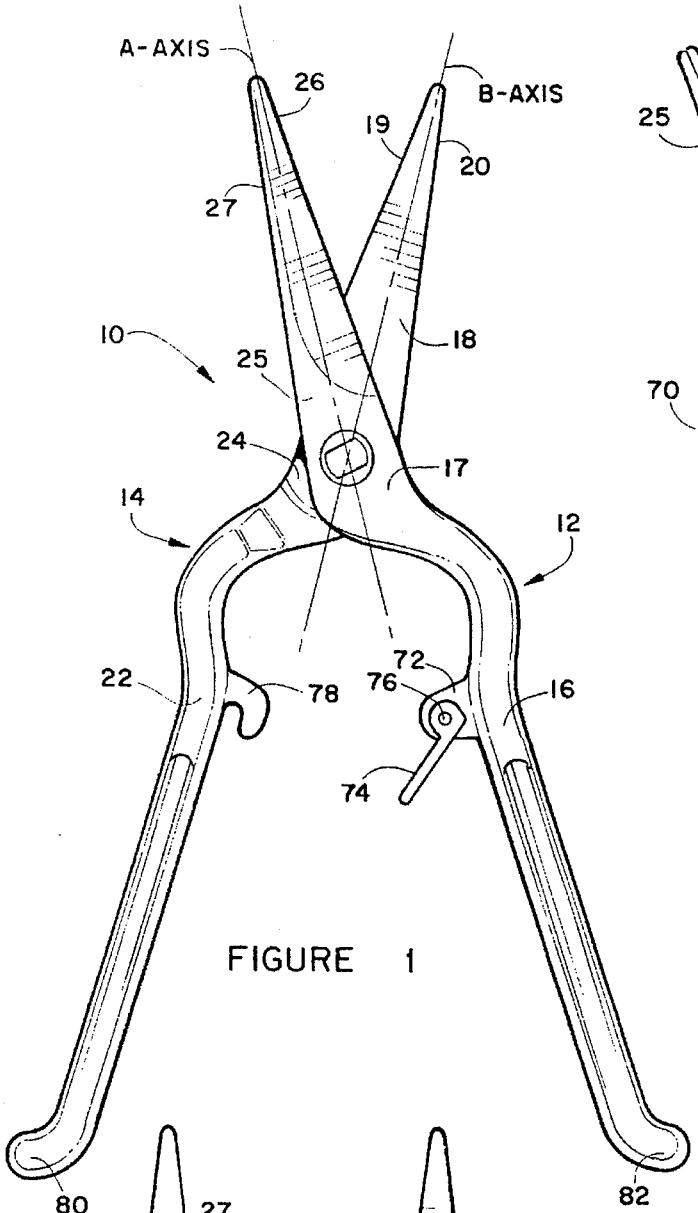
FIG. 1 is a front elevation view of the novel cutting tool.
Figure 2:
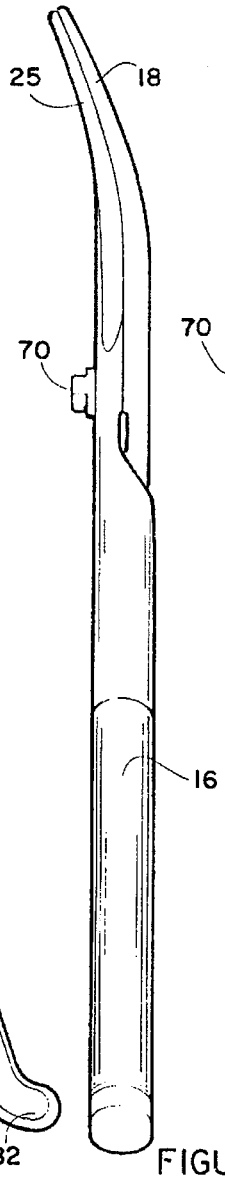
FIG. 2 is a right side elevation view of the novel cutting tool.
Figure 3:
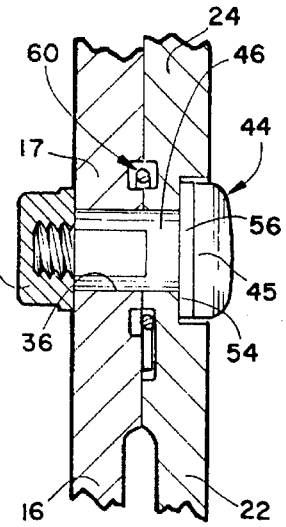
FIG. 3 is an enlarged partial cross sectional view through the respective head portions of the cutting tool.
Figure 4:
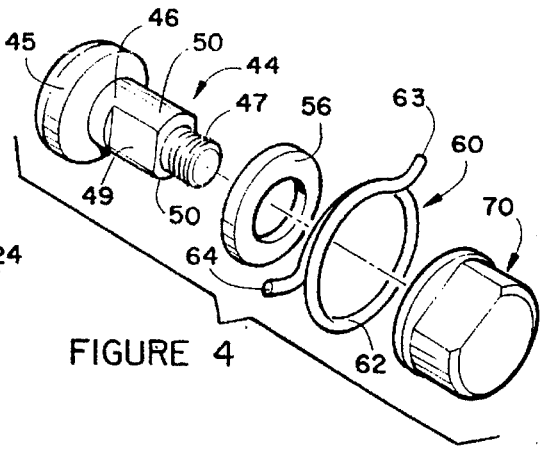
FIG. 4 is an exploded front perspective view of the coiled spring and the manner in which it is captured between the bolt and cap nut.
Figure 5:
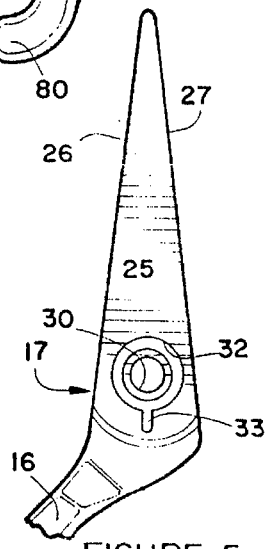
FIG. 5 is a partial bottom plan view of the top elongated member.
Figure 6:
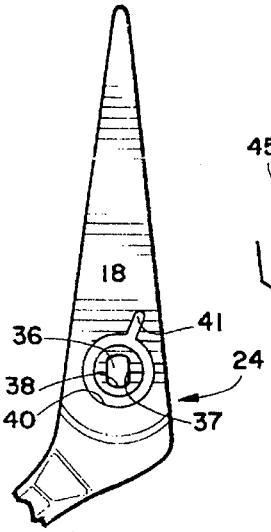
FIG. 6 is a partial top plan view of the bottom elongated member.

The novel cutting tool will now be described by referring to FIGS. 1–6 of the drawing. The cutting tool is generally designated numeral 10.

Cutting tool 10 has a pair of elongated members 12 and 14. Elongated member 12 has a handle portion 16 and a head portion 17. A blade section 18 extends forwardly from head portion 17 and it has a front cutting edge 19 and a rear edge 20. Elongated member 14 has a handle portion 22 and a head portion 24. A blade section 25 extends forwardly from head portion 24 and it has a front cutting edge 26 and a rear edge 27. Blade section 18 has a longitudinal B-axis and blade section 25 has a longitudinal A-axis.

Head portion 17 has a circular bore hole 30 and its bottom surface has an annular groove 32. It has an axial groove 33 extending outwardly from its peripheral edge.

Head portion 24 has a bore hole 36 having opposed flat sections 37 and opposed arcuate portions 38. An annular groove 40 is formed in the top surface of head portion 24 and it has an axial groove 41 extending outwardly from its peripheral edge.

A bolt 44 has a head portion 45 and a shank portion 46 with a threaded tip 47. Shank portion 46 has opposed flat surfaces 49 and opposed arcuate surfaces 50. A counter recess 54 is formed in the bottom surface of head portion 24 and a brass washer 56 is removably seated therein. Shank portion 46 of bolt 44 is inserted through the center of washer 56 and the aligned bore holes 36 and 30 and also the center of coiled spring 60. Coiled spring 60 has a loop portion 62 and a first end 63 and a second end 64. Loop portion 62 is removably received in the respective annular grooves 40 and 32 and first end 63 is captured in axial groove 41 and second end 64 is captured in axial groove 33. A cap nut 70 is tightened on threaded tip 47 to hold all of the respective structures together.

A flange 72 extends inwardly from the inside surface of handle portion 16 and it has a closed loop latch 74 pivotally mounted on a pin 76. A hook-shaped protrusion 78 extends inwardly from the inside edge of handle portion 22. By pivoting closed loop latch 74 over hook-shaped protrusion 78 when the two handle portions a pushed together, the respective front cutting edges 19 and 26 of the blade sections can be maintained in a closed position. Outwardly bent foot portions 80 and 82 on the respective rear ends of handle portions 22 and 16 prevent the person's hand from slipping off the handle when they are using the cutting tool.

What is claimed is:

1. A cutting tool comprising:

a first elongated member having a first handle portion and a first head portion; a second elongated member having a second handle portion and a second head portion; said elongated members being pivotally secured together at a locus axis passing perpendicularly through said first and second head portions;

said first head portion having a top surface, a bottom surface and a first bore hole extending from said top surface to said bottom surface; said first bore hole having two opposed flat sections and two opposed arcuate portions; said first head portion having a first blade section having a front end, a rear edge and a front cutting edge; a first annular groove having a peripheral edge surrounds said first bore hole and said first annular groove is formed in the bottom surface of said first head portion and a first axial groove extends outwardly from its peripheral edge;

said second head portion having a top surface, a bottom surface and a second bore hole extending from said top surface to said bottom surface; said second bore hole being circular and having a circular countersunk recess in said bottom surface; said second head portion having a second blade section having a front end, a rear edge and a front cutting edge; a second annular groove having a peripheral edge surrounds said second bore hole and said second annular groove is formed in the top surface of said second head portion and a second axial groove extends outwardly from its periphery;

said blade sections each having a longitudinal axis and said blade sections curve upwardly along their respective axes from their respective head portions to their front ends;

a coiled spring having a first end, a second end and a loop portion;

the bottom surface of said first head portion is positioned on the top surface of said second head portion with their respective first and second bore holes in alignment; said coiled spring being positioned between said respective first and second head portions and removably received in said mating first and second annular grooves with said first end captured in said first axial groove and said second end being captured in said second axial groove; said coiled spring functions to keep the respective blade sections separated when there isn't any hand pressure squeezing said handle portions toward each other to perform a cutting operation;

a bolt inserted through said aligned first and second bore holes; said bolt having a head, a shank and an externally threaded tip; a portion of said shank adjacent said head has a circular cross section and it mates with the circular bore hole of said second head portion; a portion of said shank adjacent said externally threaded tip has two opposed flat surfaces and two opposed arcuate surfaces and they mate with the respective two opposed flat surfaces and two opposed arcuate surfaces of said bore hole in said first head portion; a brass washer is mounted in the circular countersunk recess in the bottom surface of said second head portion and it is self lubricating and thus allows for smooth movement in wet conditions such as dew, rain, etc.

outwardly bent foot portions are formed on the rear ends of said respective handle portions for preventing a person's hand from slipping off from said handle portions when they are performing a cutting function; and means for locking said handle portions together so that said blade sections are in an open position comprising: said second handle having an inwardly extending hook-shaped protrusion and said first handle having an inwardly extending flange with a closed loop latch pivotally mounted thereon; said respective first and second blade sections can be locked together by squeezing said first and second handle portions together and passing said closed loop latch around said hook-shaped protrusion.

* * * * *